United States Patent [19]

Snyder

[11] Patent Number: 4,486,050

[45] Date of Patent: Dec. 4, 1984

[54] RECTANGULAR TUNNEL BORING MACHINE AND METHOD

[75] Inventor: Larry L. Snyder, Golden, Colo.

[73] Assignee: Harrison Western Corporation, Lakewood, Colo.

[21] Appl. No.: 463,894

[22] Filed: Feb. 8, 1983

[51] Int. Cl.[3] ..... E21D 9/10

[52] U.S. Cl. ..... 299/18; 299/31; 299/89; 175/91

[58] Field of Search ..... 299/31, 89, 10, 18; 175/91

[56] References Cited

U.S. PATENT DOCUMENTS

| | | | |
|---|---|---|---|
| 475,833 | 5/1892 | Wantling et al. | 299/89 X |
| 678,045 | 7/1901 | Seltner | 299/89 X |
| 2,758,826 | 8/1956 | Paget | 299/89 X |
| 4,035,024 | 7/1977 | Fink | 299/31 |

*Primary Examiner*—Ernest R. Purser
*Attorney, Agent, or Firm*—Klaas & Law

[57] ABSTRACT

A machine for boring a tunnel having an end face wall, a roof wall, a bottom wall, and opposite side walls. The machine comprises a rotatable cutting wheel means having an annular peripheral wall supporting a plurality of cutting devices and a generally convex-shaped upper wall supporting a plurality of cutting devices. The cutting wheel means is rotatable about an axis of rotation which is inclined in a forward direction relative to a plane perpendicular to the longitudinal axis of the tunnel for simultaneously cutting the tunnel face along two intersecting surfaces defined by the cutting devices on the annular peripheral wall and the cutting devices on the convex-shape upper wall. Support shoe means are mounted beneath the cutting wheel means for movably supporting the cutting wheel means on the tunnel floor. Drive motor means are mounted on the support shoe means and are operatively associated with the cutting wheel means for causing rotation of the cutting wheel means relative to the tunnel face and the support shoe means. Thrust means are connected to the support shoe means for advancing the cutting wheel means and the support shoe means toward the tunnel face. Gripping means are associated with the thrust means for gripping engagement with the opposite tunnel side walls to prevent axial rearward movement as the cutting wheel means and the support shoe means are advanced toward the tunnel face. Vertical and horizontal steering means for changing the direction of advance of the machine are described. Paddle means and conveyor means for removing rock cuttings from the end face of the tunnel are disclosed. Shield means for shielding workers from dust and debris and for containing the cuttings are also described.

44 Claims, 8 Drawing Figures

RECTANGULAR TUNNEL BORING MACHINE AND METHOD

BACKGROUND AND SUMMARY OF THE INVENTION

This invention relates to earth excavation machines, and, more particularly to tunnel boring machines for excavation of mine entry tunnels and haulage ways in hard rock.

A primary object of the present invention is to provide a tunnel boring machine for excavating a tunnel of generally rectangular cross-sectional configuration. The tunnel has straight sidewalls and a slightly elliptical floor and roof. The width of the excavation is nominally twice the height, but this ratio can be varied slightly to suit specific needs.

It is common mining practice to bore a series of parallel tunnels, generally referred to as "drifts", for extracting minerals in a layer of earth strata. The area between parallel drifts are referred to as columns and provide vertical support to the overlaying strata.

An important feature of the excavation shape produced by the machine of the present invention is the column or wall configuration left between parallel drifts. The elliptical fillets in the column corners which are created by this smooth wall boring machine produce minimum ground disturbance thus providing very low rock stress in the areas of the columns. This allows the thickness of the columns to be decreased providing a higher mineral extraction ratio.

For a typical 12½ ft. high×25 ft. wide tunnel entry, the cutterwheel of the machine would be 25 ft. in diameter and approximately 9 ft. tall. The cutterwheel would be oriented with its axis of rotation 10 to 15 degrees from vertical. Large rolling disc cutters which are common in tunnelling and raise boring, would be mounted on the rim and upper surface of the cutterwheel. The slight 10°–15° inclination of the cutterwheel produces the elliptical shape of the floor and roof and facilitates muck pickup under the raised back portion of the cutterwheel.

The rotating cutterwheel is urged against the rock face by longitudinal thrust cylinders. As the rotating cutterwheel is thrust into the rock face, rock between cutter discs is spalled free of the rock mass and falls to the drift floor where it is gathered by the cutterwheel paddles and deposited on a machine belt conveyor for subsequent deposit into the mine haulage system.

A feature of the machine is its ability to continually thrust the cutterwheel into the rock so that there is no time lost during a grip and reset cycle as is common with tunnel boring machines. With this feature, machine utilization rates of 75–80% can be achieved instead of 50–60% which is common with machines that must reset.

The machine advances by alternately clamping into the side walls (or the roof and floor if desired) with two sets of gripper assemblies mounted transversely relative the thrust cylinders. While the front set is gripping the rear set is resetting, then the rear set grips and the front resets thereby continually allowing the machine to thrust forward.

Each set of gripper assemblies comprises two coaxial piston arms which are independently operable and extend in opposite directions to engage opposite walls of the tunnel. By extending one piston arm a greater distance than the other associated piston arm, the machine may be moved laterally, thus providing a steering means.

A machine needed to bore a 12½ ft.×25 ft. drift in oil shale of 14,000 psi may weigh approximately 400 to 500 tons. The machine would require on the order of 1200–1400 horsepower to rotate the cutterwheel and on the order of 1,000,000 pounds of thrust to thrust the cutterwheel forward into the rock face.

BRIEF DESCRIPTION OF THE DRAWING

An illustrative and presently preferred embodiment of the invention is shown in the accompanying drawing in which.

DETAILED DESCRIPTION OF THE INVENTION

Figure 2:
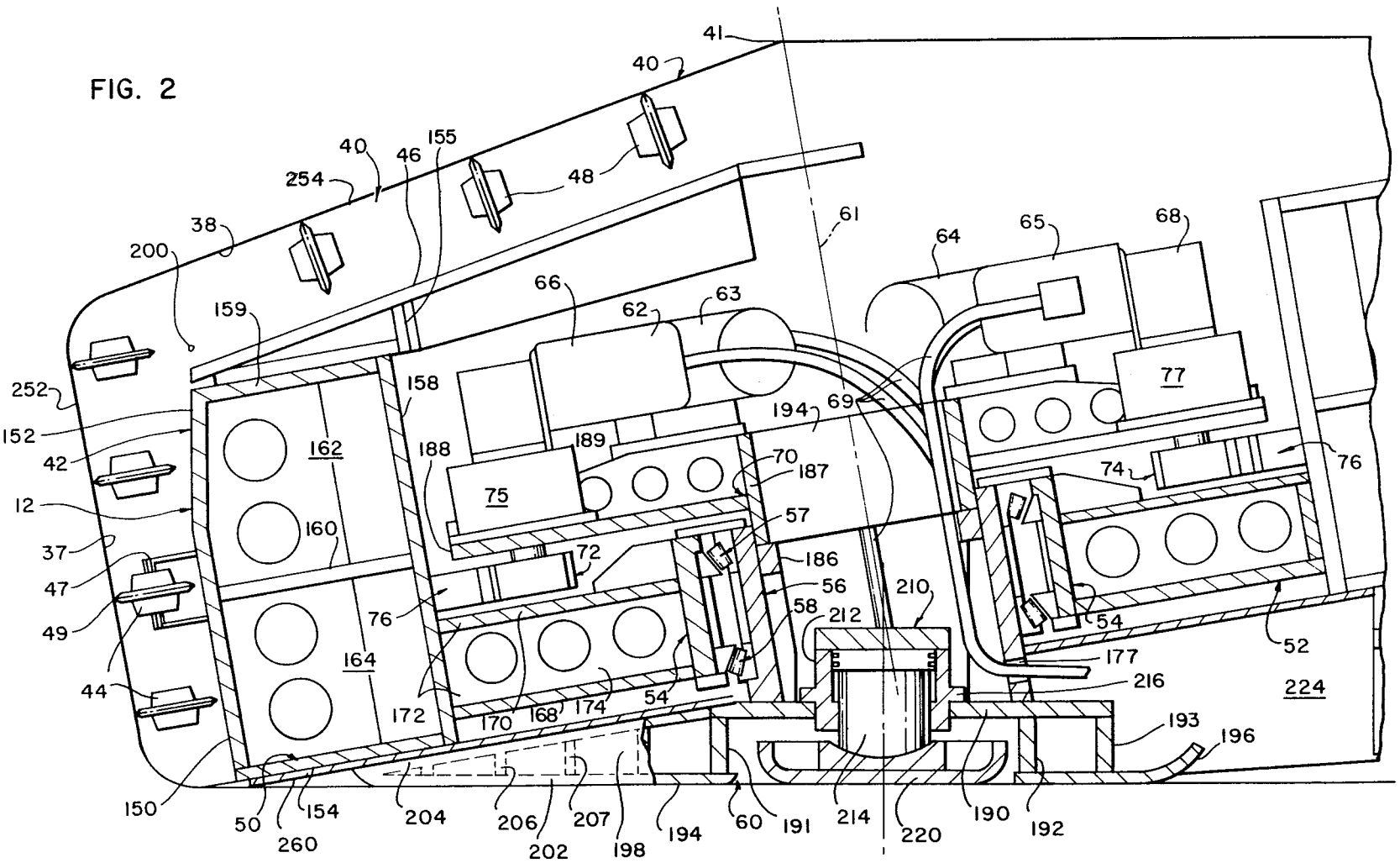
FIG. 2 is a side elevation cross-sectional view of the cutting wheel portion of the machine of FIG. 1.
Figure 5:
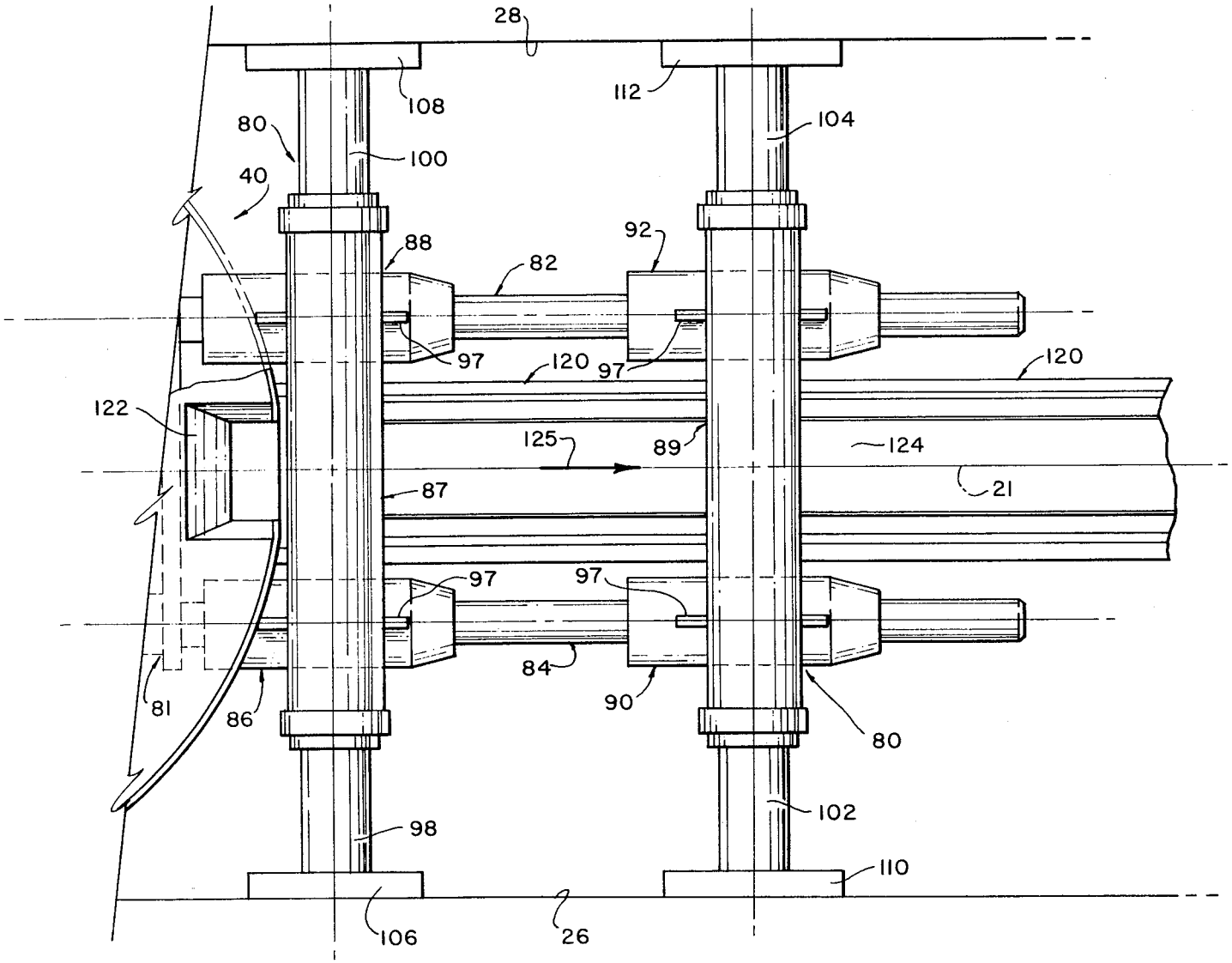
FIG. 5 is a top view of the thrust portion of the machine of FIGS. 1–4.
Figure 6:
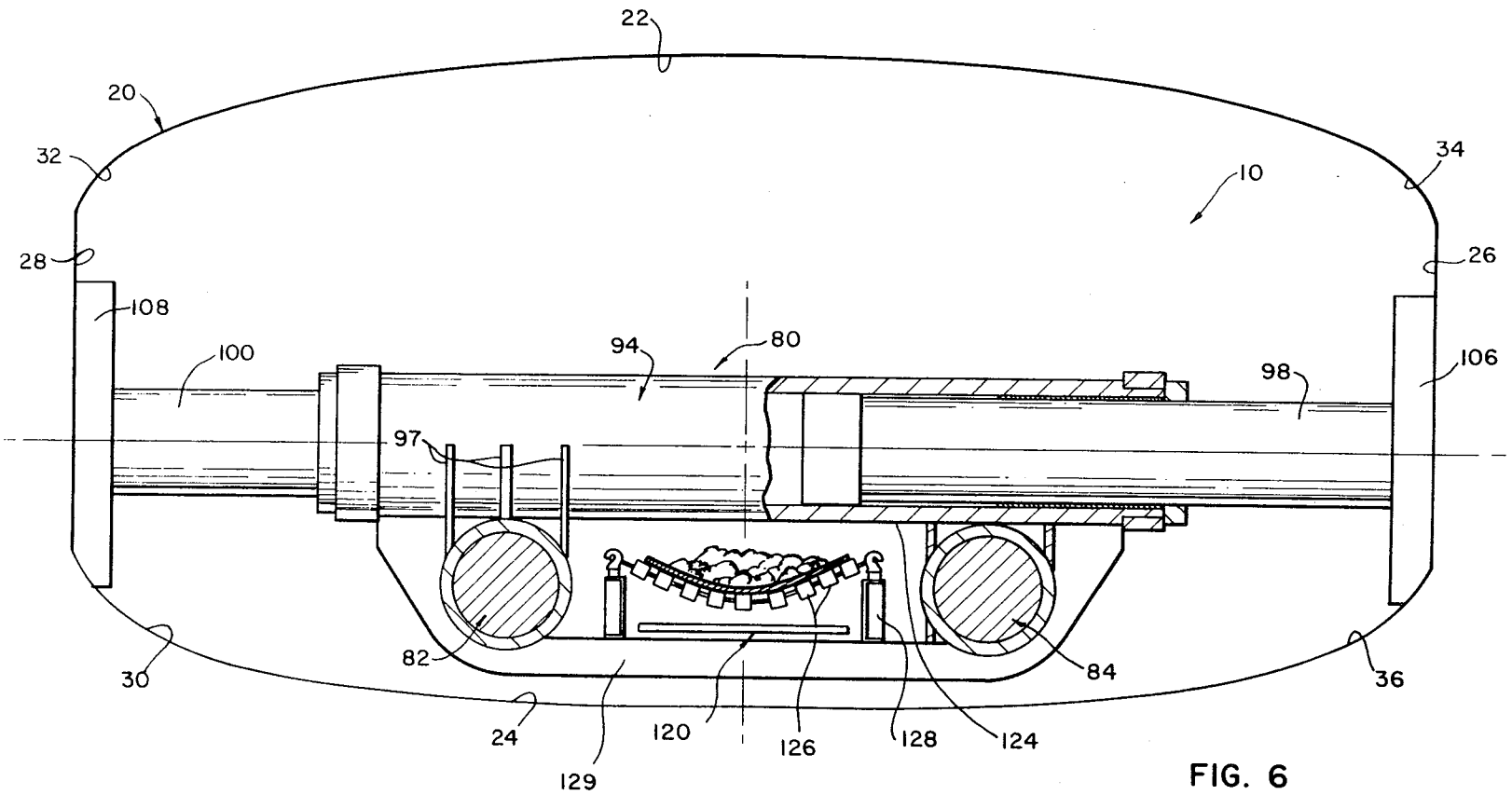
FIG. 6 is an end elevation cross-sectional view of the thrust portion of the machine of FIGS. 1–5.

In general, as shown in FIG. 6, the tunnel boring machine 10 of the present invention is designed to cut a tunnel 20 of generally rectangular cross-sectional configuration with a central longitudinal axis 21, FIG. 5, and having an elliptical roof wall portion 22, an elliptical bottom wall portion 24 and flat vertical side wall portions 26, 28 which are connected by elliptical corner wall portions 30, 32, 34, 36. The face of the tunnel, as shown by FIG. 2, comprises an inclined vertical lower portion 37 and an inclined horizontal upper portion 38. The machine 10 comprises a rotatable cutting wheel means 40 having an annular outer peripheral wall portion 42 carrying cutter devices 44 and a generally convex or dome shaped upper wall portion 46, which is conical in the presently preferred embodiment, carrying cutter devices 48. An annular support means 50, is fixedly attached to an annular hub means 54 which in turn is rotatably mounted on a support shaft means 56 by bearing means 57, 58. Support shaft means 56 is fixedly mounted on a support shoe means 60 in a forwardly upwardly inclined position to provide an inclined axis of rotation 61 of approximately 15° for the cutting wheel means. A plurality of drive motor means 62, 63, 64, 65, etc., and associated transmission means 66, 68, etc. are mounted on support frame means 70 which is fixed to shaft means 56. Each motor means may be associated with speed reducer means 75, 77, etc. and drives a pinion gear means 72, 74, etc. engaged with a ring gear means 76 fixedly mounted on annular support means 50 so as to cause rotation of annular support means 50 about support shaft means 56. A plurality of circumferentially spaced muck scraper and paddle means 78, 79 are mounted on the periphery of the cutting wheel means to carry cuttings to a conveyor means.

Figure 4:
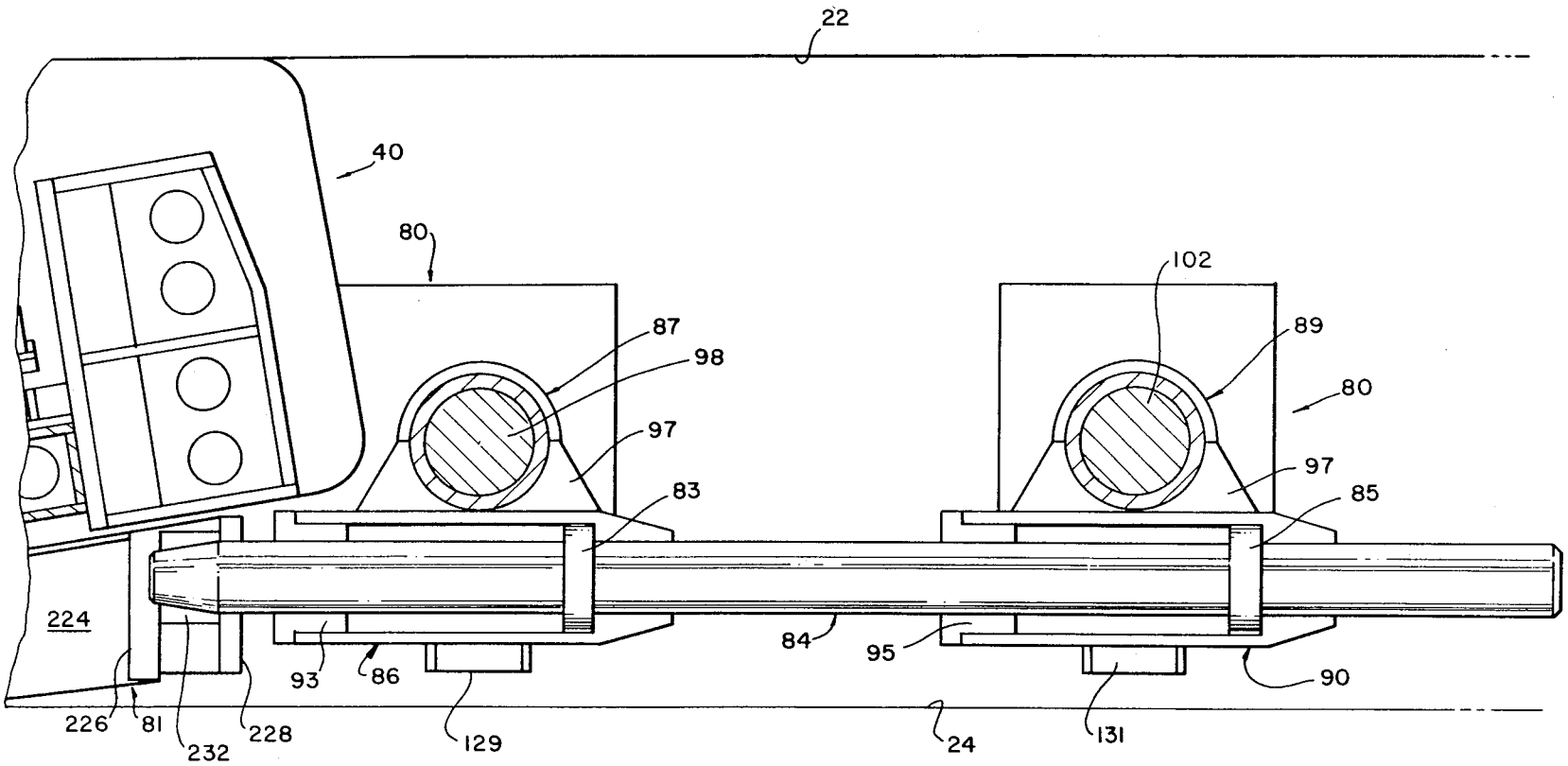
FIG. 4 is a side elevation view of the thrust portion of the machine of FIGS. 1–3.

A thrust means 80, FIGS. 4 and 5, is operatively connected to cutting wheel means 40 and support shoe means 60 by connecting means 81 for causing axial movement of the machine relative to the end face of the tunnel. Thrust means 80 comprises a pair of axially movable shaft members 82, 84 mounted in thrust cylinder means 86, 88, 90, 92 fixedly attached to support cylinder means 87, 89 having opposed separately operably piston rod means 98, 100, and 102, 104 attached to side wall gripping pad means 106, 108, 110, 112.

A muck conveyor means 120, FIGS. 5 and 6, is mounted beneath cylinder means 87, 89 along central longitudinal axis 21 to receive cuttings 200 through hopper means 122 and to carry cuttings away from the cutting wheel means 40 as indicated by arrow 125.

Rotatable Cutter Means

Figure 3:
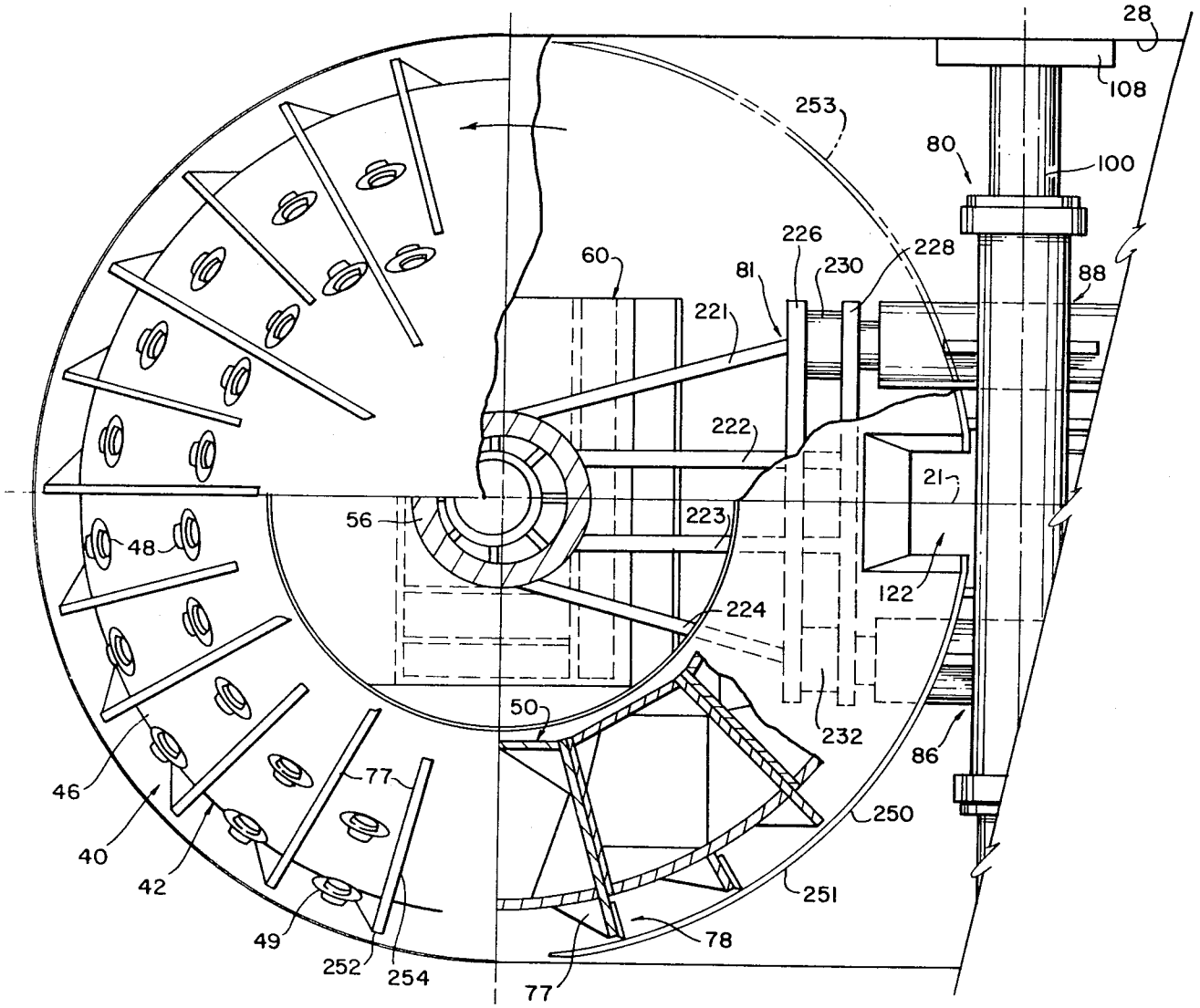
FIG. 3 is a top cut away view of the cutting wheel portion of the machine of FIGS. 1 and 2.

As illustrated by FIG. 2 and 3 the rotatable cutter wheel means 40 of the preferred embodiment has a generally cylindrically arranged peripheral cutting surface and has a conically arranged top cutting surface positioned about a central axis 61. The generally cylindrical outer peripheral wall portion 42 may comprise a lower peripheral wall portion 150 which extends parallel to axis 61 and an upper inwardly inclined peripheral wall portion 152, rigidly attached to the lower wall portion 150 and inclined inwardly at a slight angle, which may be on the order of 15°, with respect thereto. The inclination of wall portion 152 causes it to be aligned in a substantially vertical direction at the leading edge portion 12 of the cutter wheel means which facilitates the movement and collection of rock cuttings 200 as they move in a downward direction from the cutting wheel conical upper wall portion 46. The conical upper wall portion 46 is rigidly attached to the upper edge surface of wall portion 152 by rigid attachment means such as weldment or the like. Vertical cross support plates 155 may be rigidly attached in spanning relationship with intermediate portions of conical wall portions 46. The supports 155 may in turn be supported on axially aligned inner cylindrical wall portion 158 which is rigidly attached to outer peripheral wall portion 42 as by upper and lower outer annular plate members 154, 159 and radial brace plate member 160, which are in turn rigidly attached to radially and axially extending web plates 162, 164. The inner wall portion 158 may be rigidly attached to a lower annular attachment plate 168 and an upper annular attachment plate 170 which are in turn structurally supported by radial attachment plate 172 and radially extending web plates 174. Thus an annular support means 50 is provided comprising outer annular plate means 154 and annular attachment plates 168, 170 and associated structural supports therefore. The annular support means 50 is rigidly attached to an annular hub means 54 as by welded attachment of plates 168, 170 and web 174 to the outer peripheral surface of the hub means 54. The hub means 54 is in turn rotatably mounted on a support shaft means 56 by conventional bearing means 57, 58 which may be double tapered roller bearing means of conventional structure well known in the art. The support shaft means 56 may be a tubular cylindrical member having a truncated bottom portion inclined at an angle with respect to a perpendicular plane passing through axis 61. In the preferred embodiment, the angle of inclination with the perpendicular plane is substantially equal to the inward inclination of wall member 152 with respect to wall member 150 and may be on the order of 15°. The support shaft means 56 is fixedly mounted as by weldment or the like on a shoe means 60 which is described in further detail hereinafter. An annular gusset member 186 may be rigidly mounted in coaxial abutting relationship with the inner surface of support shaft means 56 near the upper portion thereof for fixedly supporting motor support means 70. Motor support means 70 may comprise motor support hub 187 and radially extending annular motor support plate 188 which may be braced by web member 189. The motor support means 70 fixedly supports a plurality of motor means 62, 63, 64, 65, etc. and associated transmission means 66, 68, etc. and speed reducer means 75, 77, etc. in rotatably displaceable relationship with respect to the annular support means 50. The motor means are drivingly attached to pinion gear means 72, 74 through speed reducer means 75, 77,etc. The motor means, speed reducer means, and pinion gear means are non-displaceably mounted on the motor support means 70. The pinion gear means 72, 74, etc. engage a ring gear means 76 which is fixedly supported on the annular support means 50 and thereby produce rotational motion of the annular support means 50 and attached peripheral wall surfaces 42, 46, etc. about the motor support means 70 and support shaft means 56.

The cutter means peripheral and inner wall portions 42, 46, 158, and annular support plates 154, 159, 168, 170, 188, etc. are constructed of high strength steel plate or the like which may have a thickness on the order of one to three inches. The support shoe means, discussed below, may be constructed of material of similar properties and dimensions. The annular hub means 54 and support shaft means 56 may be constructed of a high strength steel or the like having a thickness of approximately 4 to 6 inches.

Figure 1:
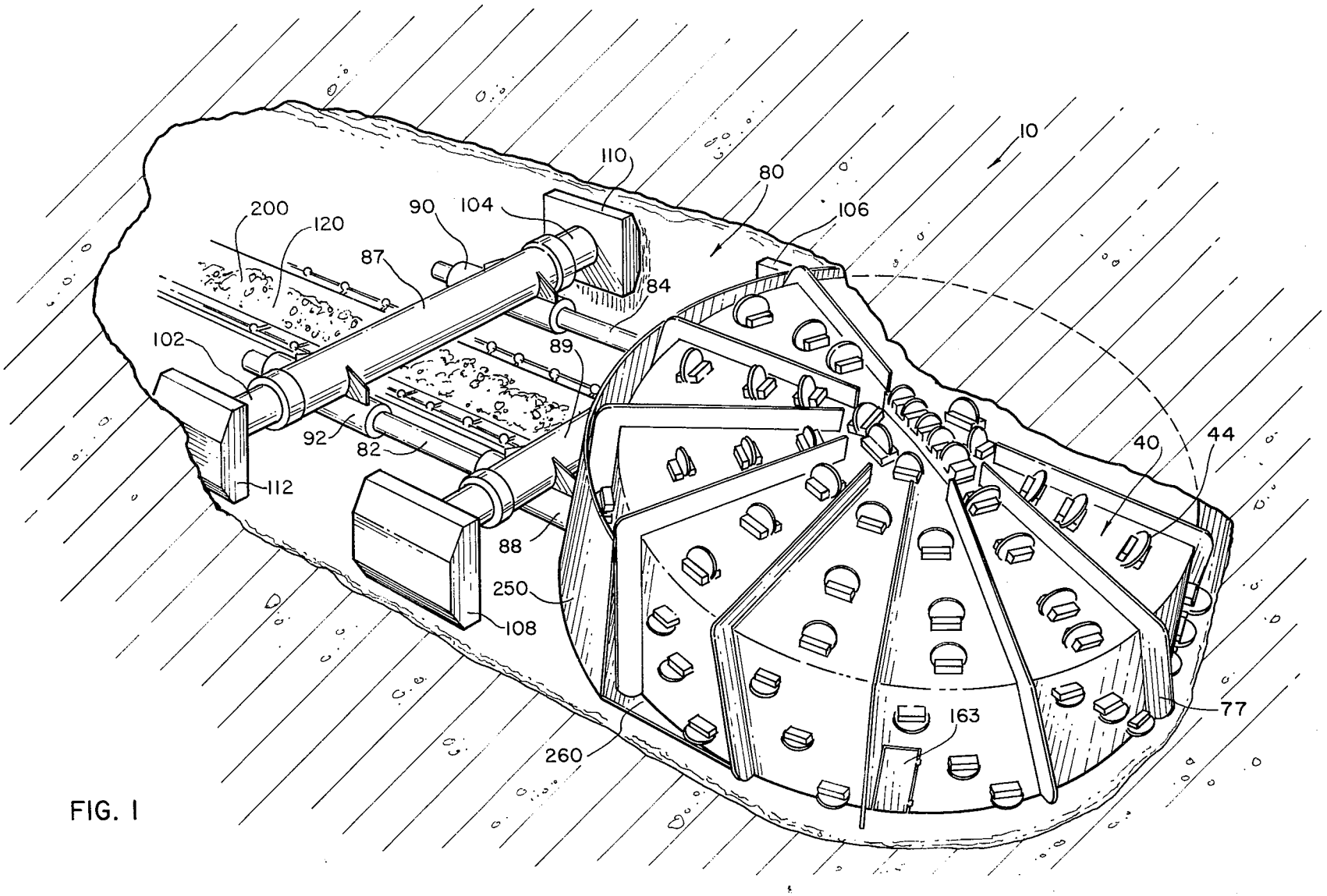
FIG. 1 is a perspective view of a tunnel boring machine of the present invention.

Access means may be provided for allowing maintenance workers to enter the interior of the wheel means 40 or for allowing passage from a rear portion to a forward portion of the cutter wheel means for maintenance of drive motor means, cutter devices, etc. The access means may comprise cutout portions (not shown) in various structural members of the cutter wheel means of sufficient size to allow human passage. The access means may also comprise a plurality of lockable hinged door means 163 mounted over cutout portions of outer peripheral wall 42 as illustrated in FIG. 1.

Support Shoe Means

As illustrated in FIGS. 2 and 3, a support shoe means 60 supports the rotatable cutter wheel means 40 in rotatable relationship thereto through support shaft means 56 which is fixedly conventionally attached to the shoe means 60. The shoe means may comprise a upper horizontally extending support member 190 to which support shaft means 56 is fixedly attached. The support plate member 190 is in turn supported by substantially vertical members 191, 192, 193, etc. which are in turn fixedly mounted on horizontally extending skid plates 194, 196. The shoe means 60 comprises a forwardly sloping triangular nose portion 198 constructed from a horizontally extending skid member 194 and a downwardly sloping forward support plate member 204 which are rigidly supportably connected as by welded vertical members 206, 207, etc. The forward sloping support plate 204 is inclined with respect to the horizontal skid 194 at an angle which places it in parallel alignment with lower annular plate member 154. A shoe cylinder means 210 having a conventional cylinder barrel 212 and cylinder piston 214 may be centrally positioned in support plate means 190 and rigidly attached thereto as by flange members 216 in an arrangement wherein piston 214 is downwardly extendable and retractable with respect to the support plate 190. The lower end of the piston 214 may be fixedly attached to an inner skid member 220 which through attachment to piston 214 is rendered vertically displaceable with respect to the remaining structure of the shoe means 60. The piston 214 may be extended to elevate the surrounding shoe structure 60 and thus the entire cutter wheel means 40 a few inches whereby the leading edge of the cutter wheel means is sufficiently raised to enable transport, maintenance operations, etc.

The shoe cylinder means 210 also provides a vertical steering means. By selectively extending or retracting piston 214 the cutting wheel may be urged upwardly or downwardly against the tunnel end face causing the tunnel portion being cut to be gradually inclined upwardly or downwardly with respect to the previously cut portion of the tunnel.

Thrust Means

As illustrated by FIGS. 2 and 3, thrust means 80 are rigidly connected to shoe means 60 by connecting means 81 comprising a plurality of thrust transmitting vertical plates 221, 222, 223, 224 which are fixedly attached to the rear vertical support plate 193 of shoe means 60 and a rear portion of the upper surface of horizontal support plate 190 as well as a rearward portion of support shaft means 56 by weldment or other rigid attachment means. The rearward end of each thrust transmitting plate 221–224 is rigidly attached to a vertically oriented plate member 226 which extends outwardly in a direction perpendicular to tunnel central axis 21. Plate 226 and parallel plate 228, of identical construction positioned rearwardly therefrom, may be weldingly attached to opposite end surfaces of socket members 230, 232. Socket members 230, 232 comprise socket holes therein for accepting terminal end portions of axially moveable shaft members 82, 84. Moveable shaft members 82, 84 are conventionally mounted in thrust cylinder means 86, 88, 90, 92 as illustrated in FIG. 4 and 5. Piston means 83, 85, etc. having hollow bores therein for accepting and selectively holding an associated shaft member in fixed relationship therewith are in turn mounted in extendable and retractable sliding relationship within an associated cylinder bore 93, 95, etc., having fluid entrance and exhaust ports (not shown) at either end for conventionally extending and retracting piston means 83, 85, etc., and the shaft members attached thereto. The shaft members may be held in fixed relationship with the piston means as by bolts, clamps, or other attachment means well-known in the art.

Thrust cylinder means 86, 88 are mounted in fixed parallel relationship, one to the other, in perpendicular relationship with support cylinder means 87 as by welded attachment plates 97. Thrust cylinder means 90, 92 are similarly mounted with respect to support cylinder means 89. Each support cylinder means 94, 96 has a pair of separately operable piston rod means 98, 100, and 102, 104, respectively, mounted in a conventionally operable manner therein. In the preferred embodiment the support cylinder means 87, 89 are positioned approximately 12 feet apart with respect to the longitudinal axes thereof at the distance of maximum separation. The hollow piston means 83, 85, etc., positioned within thrust cylinder means 86, 88, 90, 92 have a maximum piston stroke length of approximately 4 feet in the preferred embodiment. The perpendicular distance between the axis of a moveable shaft member 82, 84 and the axis of an associated support cylinder 106, 108, 110, 112 may be approximately 3 feet. Shafts 82,84 may have a diameter on the order of one foot and piston rod means 98, 100, 102, 104 may have a diameter of approximately two feet. Each piston rod has a generally rectangular shaped pad 106, 108, 110, 112 mounted on the end thereof which may have a square abutment surface having a dimension of approximately 6 feet on a side and which may be made from steel plate having a thickness on the order of 2 to 3 inches.

Figure 8:
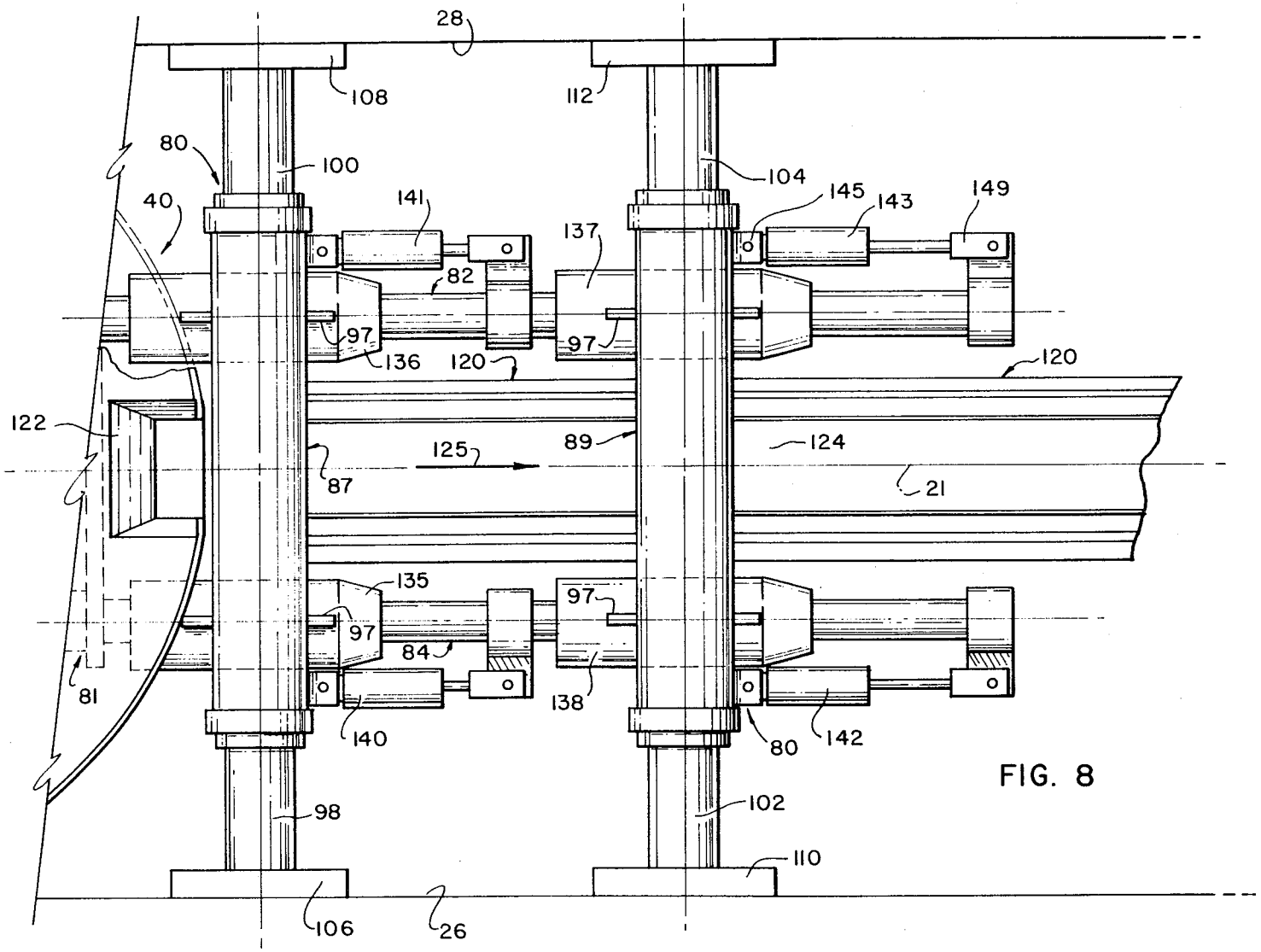
FIG. 8 is a top view of the thrust portion of an alternate embodiment of a tunnel boring machine of the present invention.

In an alternate embodiment, as illustrated by FIG. 8, support sleeves 135, 136, 137, 138 are mounted on support cylinder means 87, 89 in place of thrust cylinder means 86, 88, 90, 92. The support sleeve means 135–138 slidingly support moveable shaft member 82, 84 in parallel relationship. Thrust means for selectively moving the shaft forward or rearward relative the support sleeve means may be provided by external thrust cylinder means 140, 141, 142, 143 mounted on an external surface of support cylinder means 87, 89 as by a conventional trunnion arrangement 144. Each external thrust cylinder means comprises a conventionally extendable and retractable piston means 145, 146, 147, 148 operably attached to an associated moveable shaft member 82, 84 as by a fixed collar and trunnion arrangement 149. The external cylinder means 140–143 may be conventionally operated to produce the same movements of the shaft members 82, 84 as described herein with reference to thrust cylinder means 86, 88, 90, 92.

Drive Motor Means

Drive motor means such as motor means 62, 63, 64, 65, etc., FIG. 2, fixedly mounted on motor support means 70 are conventionally attached to speed reducer boxes 75, 77, etc. as through conventional transmission means 66, 68, etc.

In the preferred embodiment the motor means are standard electric motors well known in the art and may be water cooled AC, DC or variable frequency electric motors, having conventional electric motor controls (not shown) and receiving electric current through power lines 69. The power lines may enter the interior of shaft means 56 through an aperture 177 therein. Other types of motors such as hydraulic motors might also be employed.

Cutter Devices

As illustrated in FIGS. 1, 2 and 3, cutter means 44, 48 may comprise a plurality of conventional rolling cutter devices mounted on the peripheral wall portion 42 and upper conical wall portion 46 of the cutter wheel means as by brackets 47. The cutter devices have a cutting edge 49 which rolls over the rock face 37, 38 crushing a shallow band of rock immediately beneath the cutting surface and creating associated fracture zones. A fracture zone extends from one crushed band to the other at a depth generally several times the depth of the crushed bands. The rock in the fracture zones separates from the rock wall surface and falls to the bottom wall 36 of the tunnel in the form of rock cuttings 200 where it is thereafter moved by paddle and muck scraper means described in further detail below. Cutting a rock wall by the use of spaced roller cutter devices is well known in the art.

In the present invention, approximately half of the cutting devices are peripheral wall cutter devices 44 positioned with their axes of rotation in parallel alignment with axis 61 whereby the cutting edges 49 roll in planes substantially perpendicular to drive shaft 64. The remainder of the cutter devices are top surface cutter devices 48 positioned with cutting edges 49 projecting from the upper surface 46 of the cutter wheel means and having axes which are inclined with respect to axis 61 and intersect axis 61.

Thus it may be seen that the rock cutting operation takes place at the leading edge 12 (downwardly inclined) portion of the rotating cutter wheel means by cutter devices on both the peripheral surface 42 and the upper surface 46 as illustrated in FIG. 2.

Paddle Means

As rock chips are cut by the leading edge portion of the cutter wheel means, gravity causes the chips to fall downward to the tunnel bottom wall 36. Radially extending paddles means 77 are fixedly attached to surfaces 42 and 46 by conventional means such as weldment and have an outer axially extending edge surface 252 and a radially extending edge surface 254 which may be provided with high strength weldingly attached muck scraper plates 78. The paddle means extends outwardly a distance slightly less than the portions of the cutter device making contact with the rock face. The paddle means thus "sweep" the rock cuttings along in the direction of rotation of the cutter wheel means. During the first portion of this sweeping motion the rock cuttings 200 are contained between adjacent paddle means and the bottom 24 and lower face portion 37 of the sidewall at the forward portion of the tunnel. However, at a position where a paddle has rotated a few degrees from the forward most point of the cutter wheel means it is necessary to provide a support base means 260, FIG. 1, along which the chips may be swept upwardly and rearwardly as described below.

Shield Means and Cuttings Support Means

Figure 7:
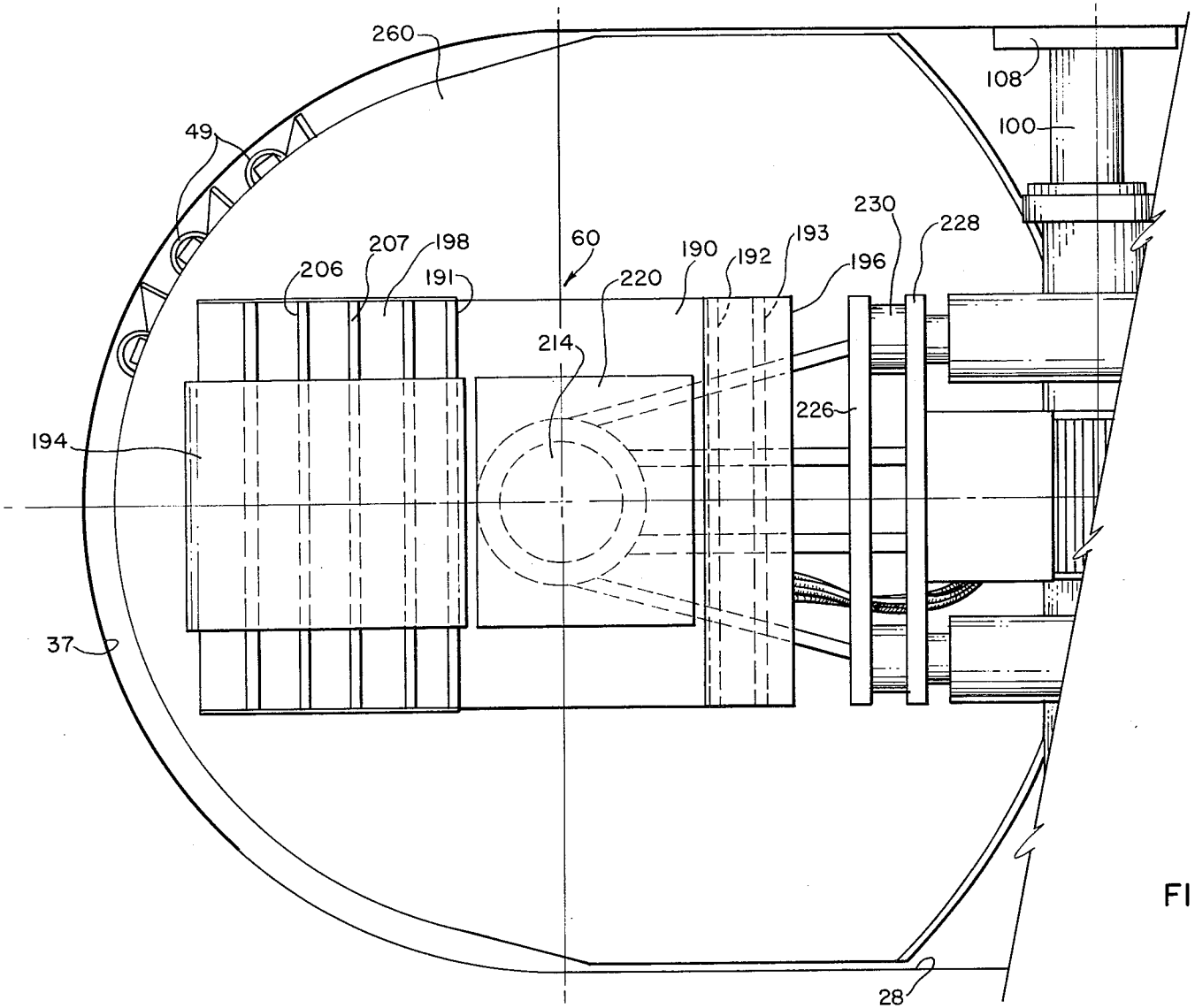
FIG. 7 is a bottom view of the cutting wheel portion of the machine of FIGS. 1–6.

As illustrated by FIGS. 1 and 3, an arcuate shield means 250 comprising two shield members 251, 253 is positioned in concentric relationship with respect to lower peripheral wall member 150 in near touching relationship with paddle means edge 252. The shield extends axially upward from a position approximately parallel to the base of the wheel means 40 to a position approximately parallel to a plane perpendicular to the central axis 61 and intersecting the top point 41 of conical wall 40. The shield means 250 is supported on an ovoid shaped cuttings support means 260, FIG. 7, which is positioned in parallel relationship with the lower surface of the paddle members for the purpose of retaining cuttings 200 swept rearwardly by the paddle means into conveyor means 122. The support means 260 extend from a forward point whereat the paddle wheels are no longer in touching or near touching relationship with the tunnel bottom wall surface 24 and extends arcuately about the lower peripheral portion of the wheel terminating at the entrance chute 122 to horizontal conveyor means 120. Thus it can be seen that cuttings 200 upon being cut and falling between a pair of paddles 78 are swept rearwardly in contained engagement between the paddles and the tunnel surface until reaching a point where the paddles disengage from the tunnel surface at which point the cuttings 200 are retained between paddles by the shield means 250 and support means 260 until being deposited in chute 122. The shield means 250 also acts to limit the flow of dust and other debris from the cutter wheel means into rearward areas of the tunnel.

Conveyor Means

As illustrated by FIGS. 5 and 6, a horizontal conveyor means 120 having a conveyor mouth 122 and a conveyor belt 124 extending rearwardly therefrom parallel to horizontal axis 124 accepts rock cuttings 200 from the cutter wheel means 40 and conveys it rearwardly through the tunnel to other conventional transport or removal means. The conveyor belt 124 may be driven by conventional drive roll means (not shown) and is conventionally supported on a plurality of idler rolls 126 in turn supported on conveyor housing means 128. The conveyor housing means may in turn be mounted on horizontal support plates 129, 131 fixedly mounted between associated pairs of thrust cylinders 86, 88, 90, 92. In the presently preferred embodiment the conveyor belt may have a width of approximately four feet.

Operation

In operation of the machine, one and/or the other of the opposite pairs of wall gripping pads 106, 108, 110, 112 are fixedly engaged with opposite side walls 26, 28 of the tunnel by actuation of support cylinder means 87 and 89 to cause piston rod means 98, 100 and 102, 104 to be extended. When one pair of gripping pads is in gripping engagement with the tunnel side walls, the other pair of gripping pads may be retracted to a non-gripping position by actuation of the associated one of the support cylinder means 87, 89. Then the associated one of the support cylinder means 87, 89 may be moved relative moveable shaft means 82, 84 to a new forwardly displaced position. Then the one pair of gripping pad means are again extended into gripping engagement with the tunnel side walls whereafter the other pair of gripping pad means may be retracted and repositioned. In this manner, the cutting wheel means may be continuously advanced into the tunnel face without stopping the cutting operation to reset the gripping pad means. In addition, each of the gripping pad piston rod means 98, 100, 102, 104 are separately actuable to different length positions to provide steering means for changing the direction of movement of the cutting wheel means 40 into the tunnel face.

One or the other or both of the pairs of power cylinder means 86, 88 and 90, 92 provide forward thrust on the cutting wheel means 40 through shaft means 82, 84, connecting means 83 and sled means 60.

It is contemplated that the inventive concepts herein described may be variously otherwise embodied and it is intended that the appended claims be construed to include alternative embodiments of the invention except insofar as limited by the prior art.

The invention claimed is:

1. A machine for boring a tunnel having an end face wall, a roof wall, a bottom wall, and opposite side walls which comprises:

a rotatable cutting wheel means having an annular peripheral wall supporting a plurality of cutting devices and a generally convex shaped upper wall supporting a plurality of cutting devices and being rotatable about an axis of rotation which is inclined in a forward direction relative to a plane perpendicular to the longitudinal axis of the tunnel for simultaneously cutting the tunnel face along two intersecting surfaces defined by said cutting devices on said annular peripheral wall and said cutting devices on said convex-shape upper wall;

cutting wheel support means centrally mounted in said cutting wheel means for rotatably supporting said cutting wheel means;

support shoe means mounted beneath said cutting wheel support means for movably supporting said cutting wheel means on the tunnel floor;

drive motor means mounted on said cutting wheel support means and operatively associated with said cutting wheel means for causing rotation of said cutting wheel means relative to the tunnel face and said cutting wheel support means;

thrust means connected to said cutting wheel support means for advancing said cutting wheel means and said support shoe means toward the tunnel face; and gripping means associated with said thrust means for gripping engagement with the opposite tunnel side walls to prevent axial rearward movement as said cutting wheel means and cutting wheel support means and said support shoe means are advanced toward the tunnel face.

2. The invention of claim 1 further comprising rock cutting removal means for removing rock cuttings from the tunnel end face during machine boring.

3. The invention of claim 2 said rock cuttings removal means comprising paddle means mounted on said annular peripheral wall and said dome shaped upper wall for sweeping rock cuttings from the surface on the end face wall being cut to a position rearwardly removed from the end face wall.

4. The invention of claim 3 wherein said paddle means comprise a plurality of radially extending spaced apart paddles.

5. The invention of claim 4 said rock cuttings removal means comprising rock cuttings support means for providing a vertical support surface for the rock cuttings swept rearwardly by said paddle means.

6. The invention of claim 5 said rock cuttings removal means comprising shield means for retaining rock cuttings between said paddles and for shielding the rearward portion of the machine from dust and debris.

7. The invention of claim 6 said rock cuttings removal means comprising conveyor means for receiving rock cuttings swept rearwardly by said paddle means and conveying said rock cuttings further rearwardly through the tunnel for subsequent removal.

8. The invention of claim 2 wherein said rotatable cutting wheel means convex shaped upper wall comprises a cone shaped upper wall.

9. The invention of claim 8 wherein the surface of said cone shaped upper wall is inclined downwardly with respect to said axis of rotation of said cutterwheel means at an angle which is substantially equal to the angle of forward inclination of said rotational axis relative a plane perpendicular to the longitudinal axis of the tunnel.

10. The invention of claim 2 further comprising steering means for selectively changing the direction in which the tunnel is bored.

11. The invention of claim 10 wherein said thrust means comprise:

at least one axially moveable shaft member operably attached in thrust transmitting relationship with said shoe means and reciprocally moveably mounted on said gripping means; and at least one thrust cylinder means fixedly mounted on said gripping means for selectively axially displacing said moveable shaft member relative thereto.

12. The invention of claim 11 comprising two moveable shaft means, each shaft means being associated with two thrust cylinder means.

13. The invention of claim 12 wherein said gripping means comprises at least one support cylinder means attached to said thrust cylinder means and transversely oriented therewith and having at least one piston means for selective extendable and retractable movement along the longitudinal axis of said support cylinder means.

14. The invention of claim 13 wherein said gripping means comprises a forward support cylinder and a rearward support cylinder and wherein each said support cylinder has two spaced apart thrust cylinders mounted thereon, associated pairs of said thrust cylinders being axially aligned and operably attached to an associated moveable shaft member.

15. The invention of claim 14 wherein each said support cylinder means comprises two opposed piston means each piston means being selectively and independently moveable relative said associated support cylinder means.

16. The invention of claim 11 wherein said thrust cylinder means comprises:

a thrust cylinder barrel; and a tubular thrust piston mounted in selectively extendable and retractable relationship within said thrust cylinder barrel, said tubular thrust piston comprising a bore therethrough for receiving and holding a portion of said axially moveable shaft member in fixed relationship therewith.

17. The invention of claim 15 wherein said thrust cylinder means comprises:

a thrust cylinder barrel; and a tubular thrust piston mounted in selectively extendable and retractable relationship within said thrust cylinder barrel, said tubular thrust piston comprising a bore therethrough for receiving and holding a portion of said axially moveable shaft member in fixed relationship therewith.

18. The invention of claim 17 wherein transversely spaced apart pairs of thrust cylinder means operate in synchronized relationship and wherein longitudinally spaced apart pairs of thrust cylinder means operate in alternating relationship and wherein piston means on each support cylinder means are alternately extended into wall gripping relationship and retracted into non-gripping relationship whereby each support cylinder means and the thrust means mounted thereon is alternately advanced relative the tunnel end face and whereby at least one associated pair of support cylinder piston means are always extended in gripping relationship with said tunnel sidewalls.

19. The invention of claim 17 wherein all thrust cylinder means operate in unison and wherein all piston means on each support cylinder means operate in unison.

20. The invention of claim 11 wherein said at least one axially moveable shaft member is reciprocally moveably mounted on said gripping means by sleeve means fixedly mounted on said gripping means and wherein said at least one thrust cylinder means comprises at least an external thrust cylinder operably attached in parallel thrust transmitting relationship with said at least one axially moveable shaft member.

21. The invention of claim 2 further comprising steering means for changing the direction of forward movement of said cutterwheel means.

22. The invention of claim 17 wherein said steering means comprises horizontal steering means comprising said gripping means.

23. The invention of claim 21 wherein said steering means comprises vertical steering means comprising shoe cylinder means having a shoe cylinder piston selectively extendable and retractable in a direction substantially perpendicular to the tunnel floor.

24. The invention of claim 1 or 10 wherein said angle of forward inclination of said rotational axis relative a plane perpendicular to the longitudinal axis of the tunnel is substantially 15°.

25. The invention of claim 24 wherein said annular peripheral wall comprises:

a lower portion oriented in substantially parallel relationship with said axis of rotation and an upper portion inclined inwardly relative said lower portion at an angle of substantially 15°.

26. The invention of claim 1 wherein said drive motor means are mounted in fixed relationship relative said support shoe means.

27. The invention of claim 1 wherein said drive motor means are mounted in enclosed relationship with said rotatable cutterwheel means.

28. The invention of claim 27 wherein said cutting wheel means comprises ring gear means operatively associated with said drive motor means.

29. A method of cutting a tunnel having a generally rectangular cross-sectional configuration in a plane perpendicular to the longitudinal axis of the tunnel by removal of material from the tunnel end face with a rotatable cutting wheel having a generally cylindrical lateral cutting wheel surface with a central axis coaxial with the axis of rotation and having an upper symmetrical generally convex cutting surface with a central axis coaxial with the axis of rotation comprising the steps of tilting the cutting wheel axis of rotation in a forward direction relative a plane perpendicular to the tunnel longitudinal axis at an angle of inclination between 5° and 30°; advancing the cutting wheel against the tunnel face in a direction substantially parallel to the tunnel longitudinal axis and cutting a first tunnel face portion having a shape defined by the shape of a forward portion of the lateral cutting surface and simultaneously cutting a second tunnel face portion having a shape defined by a forward portion of the upper cutting surface of said first tunnel face portion and intersecting said second tunnel face portion at an angle substantially equal to said angle of inclination of the rotational axis plus 90° whereby the forward projection of said first tunnel face portion and said second tunnel face portion in a direction parallel the tunnel central longitudinal axis defines a three-dimensional figure having a substantially rectangular cross-sectional configuration with rounded corner portions; collecting rock cuttings at a lower, leading-edge portion of the cutting wheel and sweeping the rock cuttings peripherally rearwardly with paddle devices mounted on the cutting wheel for subsequent collection and removal from a position rearward of the cutting wheel axis of rotation and below the cutting wheel trailing edge.

30. A machine for boring a tunnel having an end face wall, a roof wall, a bottom wall, and opposite side walls which comprises:

a rotatable cutting wheel means having an annular peripheral wall supporting a plurality of cutting devices and a generally convex shaped upper wall supporting a plurality of cutting devices and being rotatable about an axis of rotation which is inclined in a forward direction relative to a plane perpendicular to the longitudinal axis of the tunnel for simultaneously cutting the tunnel face along two intersecting surfaces defined by said cutting devices on said annular peripheral wall and said cutting devices on said convex-shape upper wall;

cutting wheel support means centrally mounted in said cutting wheel means for rotatably supporting said cutting wheel means;

support shoe means mounted beneath said cutting wheel support means for movably supporting said cutting wheel means on the tunnel floor;

drive motor means operatively associated with said cutting wheel means for causing rotation of said cutting wheel means relative to the tunnel face and said cutting wheel support means;

thrust means connected in thrust transmitting relationship with said cutting wheel support means for advancing said cutting wheel and said support shoe means toward the tunnel face; and gripping means associated with said thrust means for gripping engagement with the opposite tunnel side walls to prevent axial rearward movement as said cutting wheel means and cutting wheel support means and said support shoe means are advanced toward the tunnel face.

31. The invention of claim 30 further comprising steering means for selectively changing the direction in which the tunnel is bored.

32. The invention of claim 31 wherein said thrust means comprise:

at least one axially movable shaft member operably attached in thrust transmitting relationship with said shoe means and reciprocally movably mounted on said gripping means; and at least one thrust cylinder means fixedly mounted on said gripping means for selectively axially displacing said moveable shaft member relative thereto.

33. The invention of claim 32 comprising two moveable shaft means, each shaft means being associated with two thrust cylinder means.

34. The invention of claim 33 wherein said gripping means comprises at least one support cylinder means attached to said thrust cylinder means and transversely oriented therewith and having at least one piston means for selective extendable and retractable movement along the longitudinal axis of said support cylinder means.

35. The invention of claim 34 wherein said gripping means comprises a forward support cylinder and a rearward support cylinder and wherein each said support cylinder has two spaced apart thrust cylinders mounted thereon, associated pairs of said thrust cylinders being axially aligned and operably attached to an associated moveable shaft member.

36. The invention of claim 35 wherein each said support cylinder means comprises two opposed piston means each piston means being selectively and independently moveable relative said associated support cylinder means.

37. The invention of claim 32 wherein said thrust cylinder means comprises:

a thrust cylinder barrel; and a tubular thrust piston mounted in selectively extendable and retractable relationship within said thrust cylinder barrel, said tubular thrust piston comprising a bore therethrough for receiving and holding a portion of said axially moveable shaft member in fixed relationship therewith.

38. The invention of claim 36 wherein said thrust cylinder means comprises:

a thrust cylinder barrel; and a tubular thrust piston mounted in selectively extendable and retractable relationship within said thrust cylinder barrel, said tubular thrust piston comprising a bore therethrough for receiving and holding a portion of said axially moveable shaft member in fixed relationship therewith.

39. The invention of claim 39 wherein transversely spaced apart pairs of thrust cylinder means operate in synchronized relationship and wherein longitudinally spaced apart pairs of thrust cylinder means operate in alternating relationship and wherein piston means on each support cylinder means are alternately extended into wall gripping relationship and retracted into non-gripping relationship whereby each support cylinder means and the thrust means mounted thereon is alternately advanced relative the tunnel end face and whereby at least one associated pair of support cylinder piston means are always extended in gripping relationship with said tunnel sidewalls.

40. The invention of claim 32 wherein said at least one axially moveable shaft member is reciprocally moveably mounted on said gripping means by sleeve means fixedly mounted on said gripping means and wherein said at least one thrust cylinder means comprises at least an external thrust cylinder operably attached in parallel thrust transmitting relationship with said at least one axially moveable shaft member.

41. The invention of claim 30 further comprising steering means for changing the direction of forward movement of said cutterwheel means.

42. The invention of claim 41 wherein said steering means comprises horizontal steering means comprising said gripping means.

43. The invention of claim 41 wherein said steering means comprises vertical steering means comprising shoe cylinder means having a shoe cylinder piston selectively extendable and retractable in a direction substantially perpendicular to the tunnel floor.

44. The invention of claim 30 wherein said angle of forward inclination of said rotational axis relative a plane perpendicular to the longitudinal axis of the tunnel is substantially 15°.

* * * * *